United States Patent [19]

Wartian

[11] Patent Number: 4,552,393

[45] Date of Patent: Nov. 12, 1985

[54] DOOR LATCH MECHANISM

[75] Inventor: George Wartian, East Detroit, Mich.

[73] Assignee: Wartian Lock Co., St. Clair Shores, Mich.

[21] Appl. No.: 731,761

[22] Filed: May 8, 1985

Related U.S. Application Data

[63] Continuation of Ser. No. 494,501, May 13, 1983, abandoned.

[51] Int. Cl.[4] ..... E05C 3/22

[52] U.S. Cl. ..... 292/221; 292/5

[58] Field of Search ..... 292/191, 192, 143, 207, 292/221, 5

[56] References Cited

U.S. PATENT DOCUMENTS

| | | | |
|---|---|---|---|
| 2,862,751 | 12/1958 | Schweitzer | 292/224 |
| 3,188,127 | 6/1965 | Hayes | 292/224 |
| 3,257,135 | 6/1966 | Russell et al. | 292/5 |
| 3,677,591 | 7/1972 | Waldo | 292/221 |

FOREIGN PATENT DOCUMENTS

| | | | |
|---|---|---|---|
| 471059 | 1/1951 | Canada | 292/221 |
| 34863 | 5/1929 | France | 292/143 |

*Primary Examiner*—Richard E. Moore

*Attorney, Agent, or Firm*—Barnes, Kisselle, Raisch, Choate, Whittemore & Hulbert

[57] ABSTRACT

A latch mechanism for storm doors, screen doors and the like. A pivoted latch is movable to and from an operative position in which to engage a keeper to maintain the door closed. The latch is moved away from operative position by a pusher assembly. When the door knob is turned, cam surfaces between the door knob and pusher assembly effect movement of the pusher assembly necessary to move the latch away from operative position.

7 Claims, 16 Drawing Figures

DOOR LATCH MECHANISM

This application is a continuation of application Ser. No. 494,501, filed May 13, 1983 now abandoned.

This invention relates generally to latch mechanism, and refers more particularly to a door latch mechanism for storm doors and screen doors.

SUMMARY OF THE INVENTION

The latch mechanism of this invention comprises a latch adapted to be mounted on a door for movement to and from an operative position in which to engage a keeper to maintain the door closed. A pusher assembly is provided for retracting the latch from its operative position. There is a rotatable member with cam means between the rotatable member and the pusher assembly for moving the pusher assembly to retract the latch in response to rotation of the rotatable member. Preferably the cam means comprises confronting contoured surfaces on the pusher assembly and rotatable member.

More specifically, the pusher assembly comprises a plunger mounted for reciprocation and a push rod between the plunger and the latch having one end abutting the plunger and the other end engagable with the latch.

In a preferred construction, the push rod is capable of being rotated, and means are provided for locking the latch in its operative position when the push rod is rotated. Means arealso provided, responsive to rotation of the push rod, for moving a bolt to extended position to lock the door.

These and other objects and features of the invention will become more apparent as the following description proceeds, especially when considered with the accompanying drawings.

DETAILED DESCRIPTION

Figure 1:
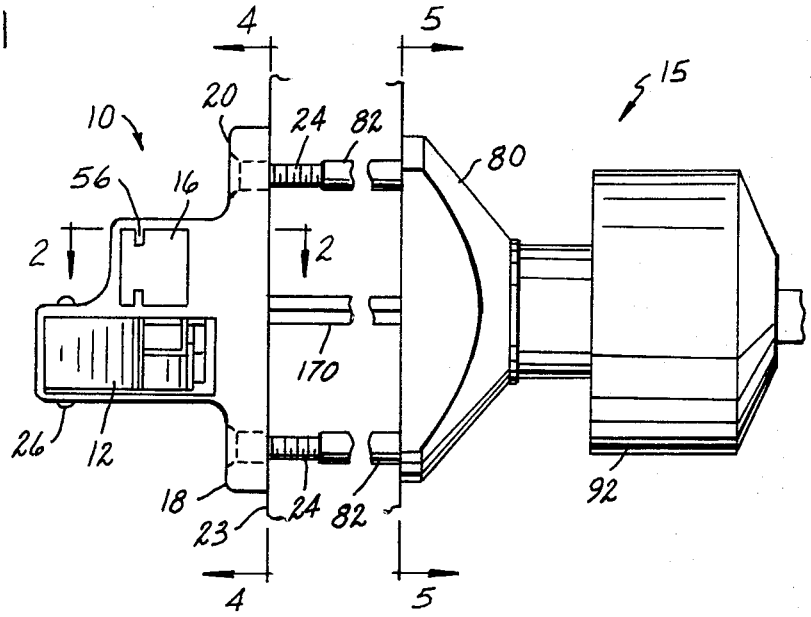
FIG. 1 is an elevational view of door latch mechanism constructed according to this invention, having components mounted on both the inner and outer sides of the door.
Figure 3:
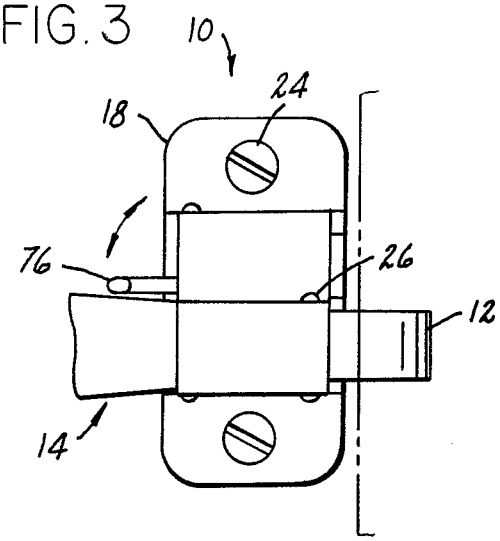
FIG. 3 is a view of the mechanism on the inner side of the door as viewed from the left in FIG. 1.

Referring now more particularly to the drawings, the door latch mechanism there shown comprises a housing 10 on the inner side of the door having a latch 12, a latch operator 14, a dead bolt 16 and bolt actuator 17. There is complementary mechanism 15 on the outer side of the door for operating the latch.

The housing 10 has a mounting portion 18 formed by a plate 20 having a marginal flange 22 extending at right angles to the plate and adapted to bear against the inner surface of the door 23 when mounted thereon adjacent to the swinging edge thereof by fasteners 24, as shown.

Figure 2:
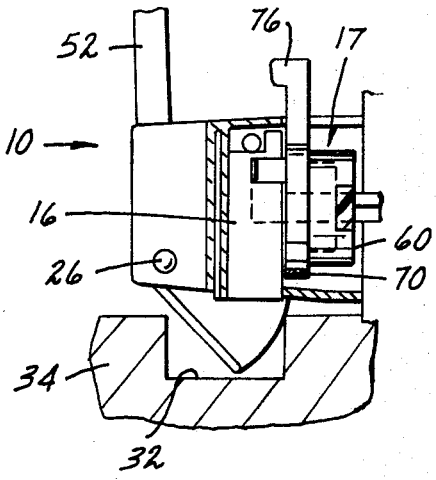
FIG. 2 is a sectional view taken on the line 2—2 in FIG. 1.
Figure 7:
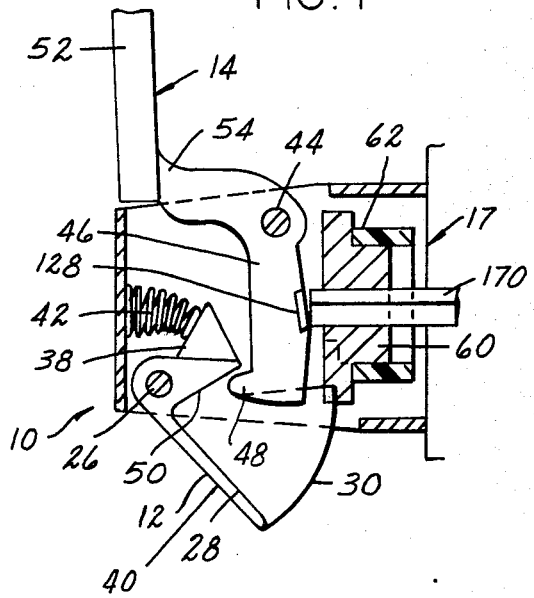
FIG. 7 is a sectional view taken on the line 7—7 in FIG. 6.

The latch 12 is pivotally mounted in the housing by a vertical pin 26. The latch has a latching arm 28 formed with an arcuate peripheral edge portion 30 adapted to engage the keeper slot 32 in a fixed door jamb 34. The latching arm 28 is relieved along one side where indicated at 36 to receive the operating arm of the latch operator 14, as more fully described hereinafter. The latch 12 has a second arm 38 at a substantial angle to the camming edge 40 of the latching arm which is engaged by a compression coil spring 42 mounted in the housing. Spring 42 presses the latch to its extended or operative position shown in FIGS. 2 and 7. The latch may be retracted to its inoperative position against the pressure of spring 42 to release the door.

The latch operator 14 is pivotally mounted in the housing on a vertical pin 44 parallel to pin 26. The latch operator has an operating arm 46, the tip 48 of which engages a surface 50 of the arm 38 of the latch to retract the latch when the latch operator is turned clockwise from the FIG. 7 position by hand pressure against the handle portion 52 formed on the second arm 54 of the latch operator.

The bolt 16 is an elongated member of generally square cross-section but relieved with slots on opposite sides to receive guide ribs 56 in the housing. The bolt is mounted in the housing for horizontal sliding movement on its longitudinal axis from an extended locking position shown in FIG. 9 in which it projects towards the door jamb for locking engagement in a complimentary recess, not shown, to a retracted position shown in FIG. 8.

The bolt actuator 17 has a hub 60 in the form of a circular disc mounted to turn cn its own central horizontal axis which is perpendicular to the pivot pins 26 and 44. The hub 60 is mounted for axial rotation within the sleeve 62. The sleeve has mounting ring portions 64 engaged over studs formed within the mounting portion of the housing and retained thereon when the housing is bolted to the door by being clamped between the surface of the door and the plate 20 of the mounting portion.

Figure 4:
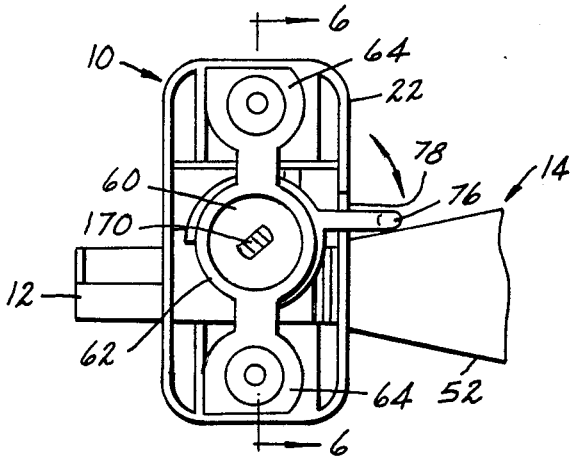
FIG. 4 is a view taken on the line 4—4 in FIG. 1.

The bolt actuator 17 has a ring 70 formed on the hub in concentric relation therewith. Ring 70 projects radially beyond the hub and has a pin 72 near its periphery on one side which extends and engages in a vertical slot 74 formed in the adjacent side of the bolt. The latch operator may be rotated manually by means of a lever 76 projecting radially from the ring 70 through an opening 78 in the housing. When the bolt actuator is in the position of FIGS. 4 and 8, pin 72 retains the bolt in the retracted or inoperative position. Rotation of the bolt to the FIG. 9 position causes pin 72 to move the bolt to its extended position in which it may project into a suitable recess in the door jamb to lock the door.

It will be noted that the ring 70 has an arcuate notch 71 in its outer edge portion of about 90° in extent. The ring is in a plane coinciding with the arcuate peripheral edge 30 of latch 12 (See FIGS. 8 and 9). When the bolt actuator is rotated to extend the bolt, the unnotched portion of the ring 70 extends behind this peripheral edge portion 30 as seen in FIG. 9, positively preventing the latch from being retracted. Hence the door is prevented from being opened not only by the bolt 16 but also by the locked condition of the latch. The effect is that of a double dead bolt. However, when the bolt operator is turned to the FIG. 8 position, the notch 71 is brought into register with the latch to provide clearance so that the latch can be retracted in the normal way.

The complementary mechanism 15 on the outer side of the door for operating the latch comprises a housing 80 secured thereto by the fasteners 24 engaging studs 82. The housing has a recess 84 on the side facing the door. A central through passage 84 in the housing opens into the bottom of the recess.

Figure 5:
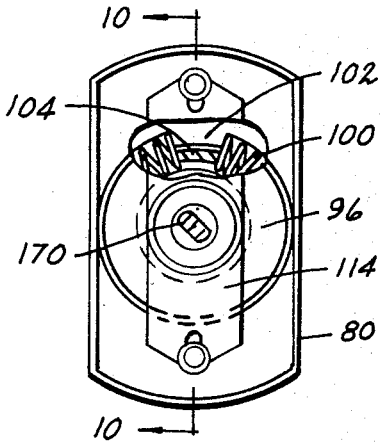
FIG. 5 is a view taken on the line 5—5 in FIG. 1, with parts broken away and in section.
Figure 6:
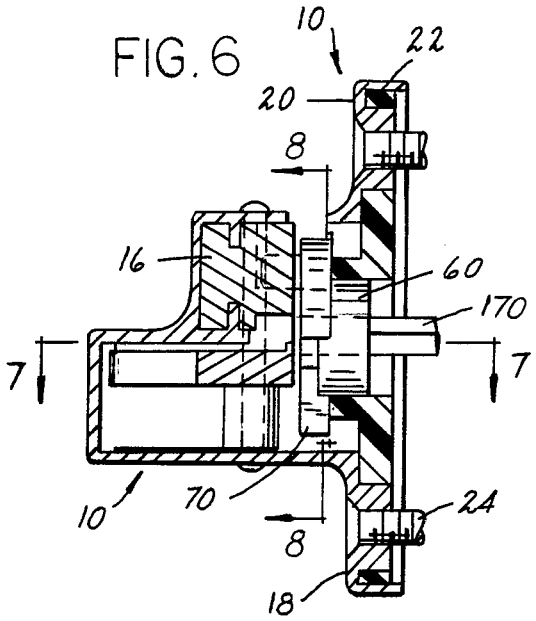
FIG. 6 is a sectional view taken on the line 6—6 in FIG. 4.

The mechanism 15 includes a rotatable member 88 having a shaft 90 and an enlarged knob 92 at one end of the shaft. The end of the shaft opposite the knob is reduced in diameter where indicated at 94. The reduced portion is rotatably received in the passage 86 of the housing. There is a disc 96 secured to the end of the reduced portion 94 of the shaft which is disposed in the recess 84 of the housing, preventing the rotatable member from being pulled out and separated from the housing. A central groove is formed in the bottom of the recess 84, and a coil spring 100 is disposed in the groove, with its ends normally compressed against a housing abutment 102 extending into the groove. The disc 96 has a projection 104 which extends into the groove between the spring ends. When the rotatable member is turned relative to the housing, the projection on the disc presses against one end or the other end of the spring, moving it away from the housing abutment 102 to compress the spring, so that when the turning force is removed the compressed spring will return the rotatable member to a neutral position of rotation (See FIG. 5).

The housing 80 has an abutment 103 extending into a circumferential groove 105 in the shaft. Abutment 103 is engageable with opposite ends of the groove when the rotatable member 88 turns to define the limits of rotation thereof.

The shaft 90 of the rotatable member is tubular, having a cylindrical bore 108 which is open at the end of the shaft adjacent to the door and closed at the end near the knob portion thereof. A sleeve 112 projects into the open end of the bore, being fixed in position with respect to the housing by a mounting plate 114 to which it is secured and the ends of which are anchored in the opposite walls of the housing recess. One end of this sleeve is turned in and defines a rectangular opening 116.

A pusher assembly 118 is provided for retracting the latch 12. The pusher assembly 118 comprises a plunger 120 and a push rod 122. The plunger has a head 124 slidable longitudinally within the bore 108 of the shaft 90, and a stem 126 projecting longitudinally from the head through the opening 116. The stem is of the same rectangular shape as the opening 116 for a close sliding fit therein. The push rod 112 is an elongated member which is aligned with the plunger. One end of the push rod engages the end of the stem 126 and the other end is disposed in a position of contact or near contact with a pad 128 on the latch Operator 14.

The end surface 129 of the plunger head confronting the closed end of the bore is contoured to provide cam surfaces as will be apparent in FIGS. 10, 11, 14, 15 and 16. The cam surfaces are arranged in a circular pattern with high points along the diametically opposed radial lines 130 and low points along the diametically opposed radial lines 132. These high and low points are alternated at 90° intervals and the cam surfaces between the high points and low points are curved somewhat spirally as seen. The end surface 134 of the bore 108 confronting the end surface 129 of the plunger is contoured like end surface 129 and will have a similar appearance, with high points along diametically opposed radial lines 138 and low points along diametically opposed radial lines 140 alternating at 90° intervals with cam surfaces of a more or less spiral configuration connecting the high and low points.

Figure 10:
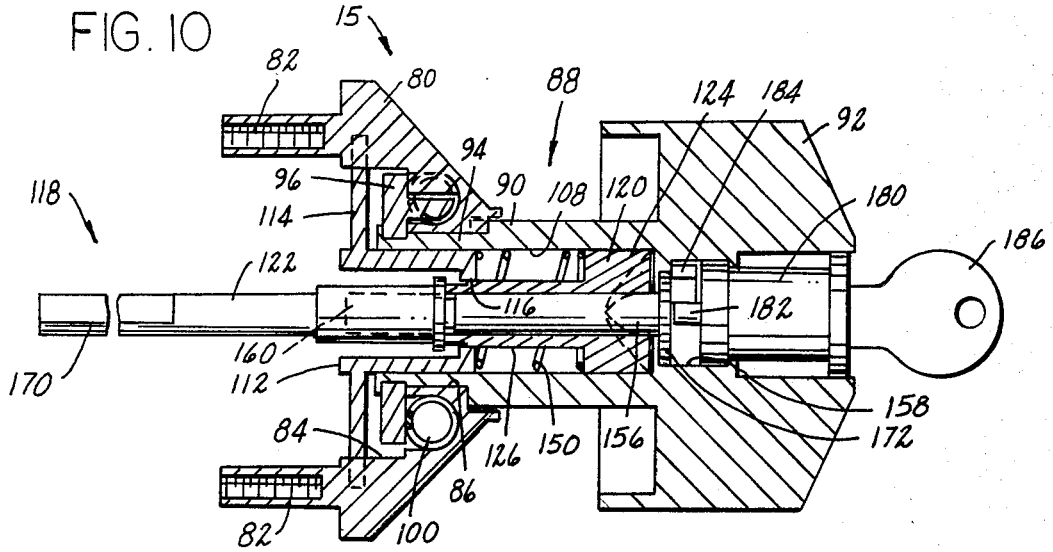
FIG. 10 is a sectional view taken on the line 10—10 in FIG. 5.
Figure 11:
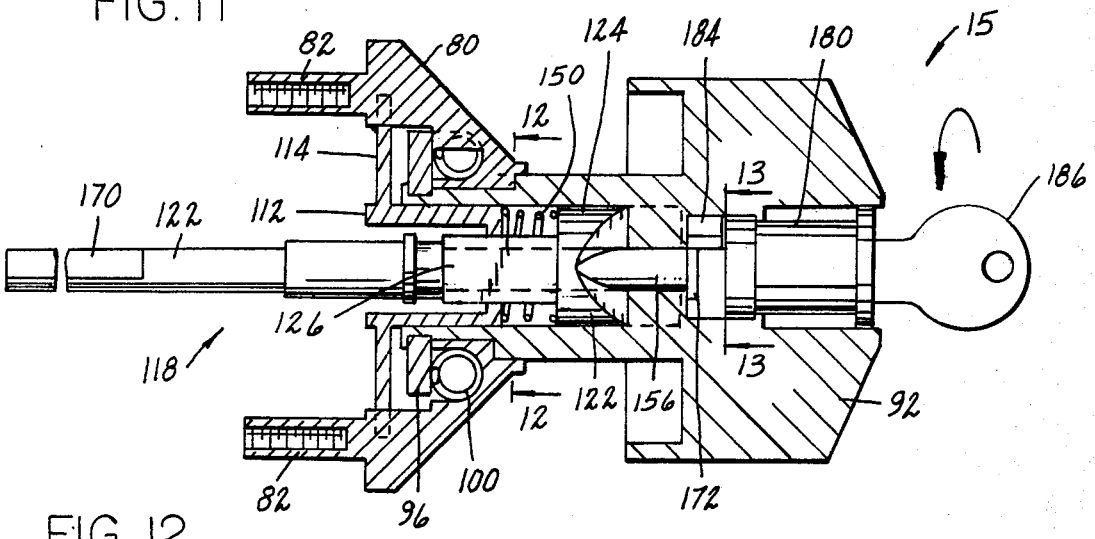
FIG. 11 is similar to FIG. 10, but shows the parts in a different position.
Figure 12:
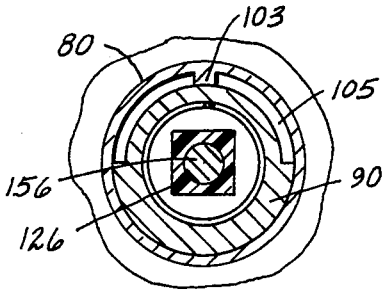
FIG. 12 is a sectional view taken on the line 12—12 in FIG. 11.
Figure 14:
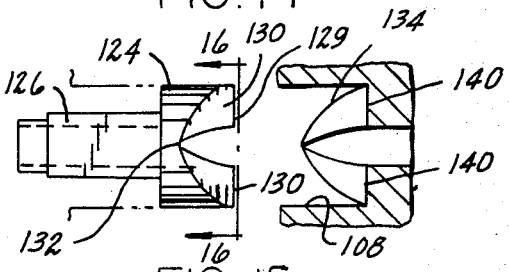
FIG. 14 is a detail view of parts of the mechanism shown in FIGS. 10 and 11, shown separated from one another for clarity.

In the position of the rotatable member 88 shown in FIG. 10, which is the neutral position, the contoured end surface of the bore compliments and fits down into the contoured end surface of the plunger, with the high points of the one mating with the low points of the other. However, when the knob is turned 90° as in FIG. 11, so that the high points of one cam surface are opposite the high points of the other, the two cam surfaces cause the pusher assembly 118 to move longitudinally to the left as will be apparent from a comparison of FIGS. 10–11. Such longitudinal movement of the pusher assembly causes the end of push rod 122 to engage pad 128 on the latch operator and retract the latch from the FIG. 7 position so that the door may be opened. When the knob is released, it returns to the neutral position of FIG. 10 by the force of spring 100, the plunger also returning to the FIG. 10 position by the force of spring 150 compressed between the plunger head and the end of sleeve 112. The latch will return to its FIG. 7 position by the force of spring 42, and the latch will push against rod 122 causing the latter to follow the plunger.

The push rod is kept aligned with the plunger stem by a pin 156 which extends from a chamber 158 in the rotatable member 88 through the wall separating the chamber from bore 108 and then through a central bore in the plunger and into the hollow end of the push rod. The end 160 of the pin and the hollow end of the push rod are of the same non-circular cross section so that there is a sliding, non-rotatable connection between them. The pin 156 extends into the push rod far enough that the two do not become separated even when the push rod is moved longitudinally as in FIG. 11.

It will be noted that the end portion of the push rod 122 is non-circular in cross section as indicated at 170. This non-circular portion extends slidably through an opening of similar cross section at the center of hub 60 of the bolt actuator 17. The bolt actuator may be turned to either of the two positions shown in FIGS. 8 and 9 by rotating the push rod 122.

Figure 13:
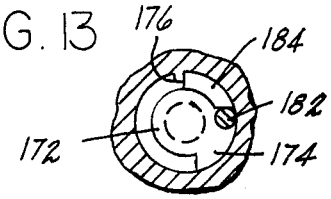
FIG. 13 is a fragmentary sectional view taken on the line 13—13, in FIG. 11.
Figure 15:
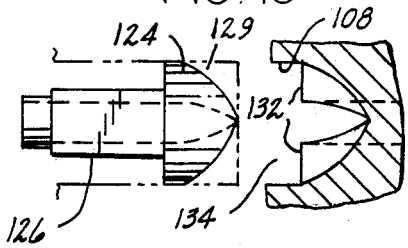
FIG. 15 is similar to FIG. 14, but shows the parts in a position 90° from that shown in FIG. 14.

Rotation of the push rod is accomplished by rotating the pin 156. As seen in FIG. 13, the pin has a head 172 in chamber 158 provided with an arcuate flange 174. A chamber abutment 176 is engageable with the ends of the flange to determine the limits of rotation of the pin.

The pin 156 is rotated by a key-operated unit having a cylinder 180 secured in the chamber 158 of the knob with a rotatable element (not shown) in the cylinder provided with a lug 182 extending into a position where it can engage the ends of an enlargment 184 on the arcuate flange of the pin head 172. A key 186 is employed to turn the lug 182 in either direction to engage one end of the enlargement or the other to rotate the pin.

Figure 8:
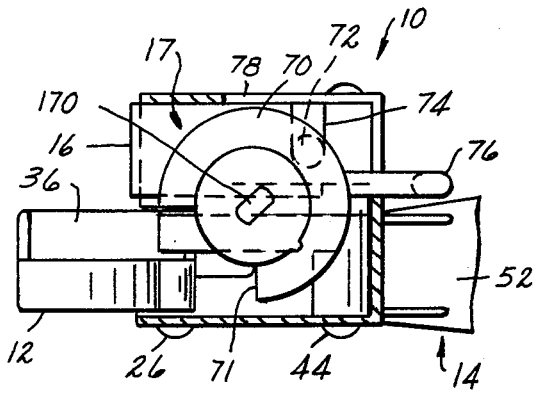
FIG. 8 is a section view taken on the line 8—8 in FIG. 6.
Figure 9:
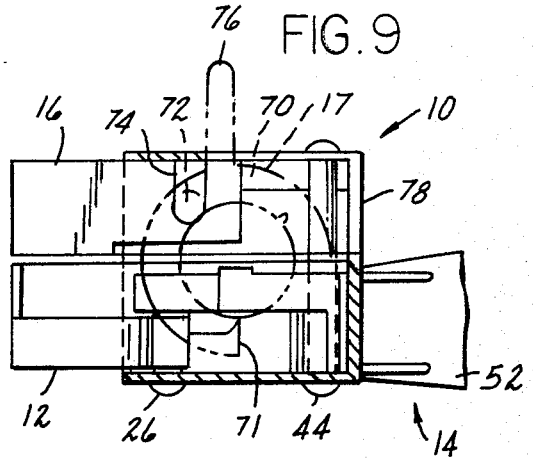
FIG. 9 is similar to FIG. 8, but shows the parts in a different position.
Figure 16:
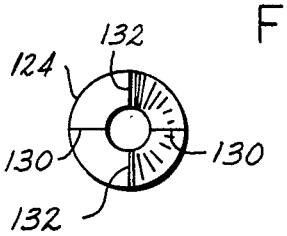
FIG. 16 is a view taken on the line 16—16 in FIG. 14.

The door may be locked and unlocked from the outside by the key 186 which turns the push rod 122 and hence the bolt actuator 17 to either one of the positions shown in FIGS. 8 and 9. In the FIG. 9 position, the bolt is extended and the latch is prevented from retracting. When by key operation the push rod is turned to place the actuator 17 in the FIG. 8 position, the door may be opened by merely rotating the knob to extend the pusher assembly and turn operator 14 clockwise in FIG. 7 to withdraw the latch.

I claim:

1. A door latch mechanism comprising a latch, means for mounting said latch on a door for movement to and from an operative position in which it is adapted to engage a keeper to maintain the door closed, a housing, a pusher assembly comprising a plunger mounted in said housing for reciprocation, a push rod between said plunger and latch extending lengthwise in the direction of plunger movement and having one end abutting said plunger, the other end of said push rod being operable to move said latch away from its operative position in response to longitudinal movement of said push rod in one direction, a rotatable member, cam means between said rotatable member and plunger for moving said plunger and hence said push rod in said one direction in response to rotation of said rotatable member to move said latch away from its operative position, said cam means comprising confronting contoured surfaces on said pusher assembly and rotatable member, spring means urging said plunger in a direction opposite said one direction, said push rod being rotatable between a first position and a second position, means for rotating said push rod, and means for locking said latch in its operative position in response to rotation of said push rod from its first to its second position.

2. The mechanism defined in claim 1, wherein said means for rotating said push rod comprises a pin extending through a passage in said plunger and having a non-rotatable, sliding connection with said push rod, and key-operated means for rotating said pin to effect rotation of said push rod.

3. A door latch mechanism comprising a latch, means for mounting said latch on a door for movement to and from an operative position in which it is adapted to engage a keeper to maintain the door closed, a housing, a pusher assembly comprising a plunger mounted in said housing for reciprocation, a push rod between said plunger and latch extending lengthwise in the direction of plunger movement and having one end abutting said plunger, the other end of said push rod being operable to move said latch away from its operative position in response to longitudinal movement of said push rod in one direction, a rotatable member, cam means between said rotatable member and plunger for moving said plunger and hence said push rod in said one direction in response to rotation of said rotatable member to move said latch away from its operative position, said cam means comprising confronting contoured surfaces on said pusher assembly and rotatable member, spring means urging said plunger in a direction opposite said one direction, said push rod being rotatable between a first position and a second position, means for rotating said push rod, a bolt movable from a retracted position to an extended position engageable with a keeper recess to lock the door in closed position, and means for moving said bolt to its extended position in response to rotation of said push rod from its first to its second position.

4. The mechanism defined in claim 3, wherein said means for rotating said push rod comprises a pin extending through a passage in said plunger and having a non-rotatable, sliding connection with said push rod, and key-operated means for rotating said pin to effect rotation of said push rod.

5. The mechanism defined in claim 3, including means for locking said latch in its operative position in response to rotation of said push rod from its first to its second position.

6. The mechanism defined in claim 5, wherein said means for rotating said push rod comprises a pin extending through a passage in said plunger and having a non-rotatable, sliding connection with said push rod, and key-operated means for rotating said pin to effect rotation of said push rod.

7. A door latch mechanism comprising a latch. means for mounting said latch on a door for movement to and from an operative position in which it is adapted to engage a keeper to maintain the door closed, a housing, a pusher assembly comprising a plunger mounted in said housing for reciprocation, a push rod between said plunger and latch extending lengthwise in the direction of plunger movement and having one end abutting said plunger, the other end of said push rod being operable to move said latch away from its operative position in response to longitudinal movement of said push rod in one direction, means for moving said plunger and hence said push rod in said one direction to move said latch away from its operative position, spring means urging said plunger in a direction opposite said one direction, said push rod being rotatable between a first position and a second position, means for rotating said push rod, and means for locking said latch in its operative position in response to rotation of said push rod from its first to its second position.

* * * * *